US009351346B2

(12) United States Patent
Arai et al.

(10) Patent No.: US 9,351,346 B2
(45) Date of Patent: May 24, 2016

(54) MATERIAL HEATING AND PROVIDING APPARATUS

(71) Applicant: DENSO CORPORATION, Kariya, Aichi-pref. (JP)

(72) Inventors: Tsuyoshi Arai, Nagoya (JP); Satoshi Takeuchi, Nagoya (JP); Noriyasu Inomata, Toyota (JP)

(73) Assignee: DENSO CORPORATION, Kariya (JP)

( * ) Notice: Subject to any disclaimer, the term of this patent is extended or adjusted under 35 U.S.C. 154(b) by 474 days.

(21) Appl. No.: 13/720,158

(22) Filed: Dec. 19, 2012

(65) Prior Publication Data

US 2013/0213957 A1 Aug. 22, 2013

(30) Foreign Application Priority Data

Feb. 22, 2012 (JP) ..... 2012-036015

(51) Int. Cl.
*H05B 6/46* (2006.01)
*H05B 6/64* (2006.01)

(52) U.S. Cl.
CPC ..... *H05B 6/46* (2013.01); *H05B 6/6408* (2013.01)

(58) Field of Classification Search
CPC ..... H05B 6/64; H05B 6/46; H05B 6/54; H05B 6/6402; H05B 6/6408; H05B 6/6414
USPC ..... 219/764, 774, 756, 762, 678
See application file for complete search history.

(56) References Cited

U.S. PATENT DOCUMENTS

| | | | | | |
|---|---|---|---|---|---|
| 4,687,895 | A * | 8/1987 | Chitre et al. | ..... | 219/701 |
| 5,512,736 | A * | 4/1996 | Kang et al. | ..... | 219/750 |
| 5,981,923 | A * | 11/1999 | Jackson | ..... | 219/679 |
| 6,423,955 | B1 * | 7/2002 | Blaker et al. | ..... | 219/775 |

FOREIGN PATENT DOCUMENTS

| | | | |
|---|---|---|---|
| JP | A-61-502849 | | 12/1986 |
| JP | A-06-021113 | | 1/1994 |
| JP | A-2003-264057 | | 9/2003 |
| JP | A-2004-218967 | | 8/2004 |
| JP | 2008145176 | A * | 6/2008 |
| JP | A-2009-250474 | | 10/2009 |
| JP | A-2010-216782 | | 9/2010 |
| WO | WO 86/01065 | | 2/1986 |

* cited by examiner

*Primary Examiner* — Tu B Hoang
*Assistant Examiner* — Michael Hoang
(74) *Attorney, Agent, or Firm* — Oliff PLC

(57) ABSTRACT

A dielectric heating system which is provided with a high frequency oscillator, a housing which forms part of a waveguide and is provided with a loading opening and unloading opening, first and second conductive closing members which respectively close the loading opening and the unloading opening from the inner side of the housing, and a first position holding member which holds the object to be heated inside the housing, which makes the first conductive closing member slide to open the loading opening and charges the object to be heated into the housing, and which makes the second conductive closing member slide to open the unloading opening and unload the object to outside the housing.

8 Claims, 6 Drawing Sheets

MATERIAL HEATING AND PROVIDING APPARATUS

BACKGROUND OF THE INVENTION

1. Field of the Invention

The present invention relates to a dielectric heating system of a dielectric material such as a synthetic resin material, more particularly to heating of a thermosetting resin such as an epoxy resin or phenol resin.

2. Description of the Related Art

In molding of a plastic, in general the material is heated to make it plastic and then is injected into a mold etc. to impart a desired shape. For example, in the related art such as shown in FIG. 1 and in Unexamined Patent Publication No. 2009-250474, there is known the technique of placing an object to be heated between parallel electrodes and applying a high frequency wave to the electrodes for causing dielectric heating. Further, there is also generally known the technique of converting a microwave which is generated by a magnetron into a standing wave by using a waveguide, placing the object to be heated inside the waveguide, and heating it by dielectric heating. By using such a technique, for example, compared with heating by conduction, the object to be heated can be heated more uniformly and at a higher speed. However, when loading and unloading an object to be heated into and from electrodes or a waveguide, the electrodes as a whole have to be lifted up or part of the waveguide has to be detached to load and unload the object.

Further, in the related art such as shown in FIG. 2, when taking out the heated material from between the electrodes or from inside the waveguide, the handling ability by a robot hand etc. has to be considered. In such a case, in general, the temperature of the object to be heated has to be kept within a temperature range where the object will not deform due to being gripped by the robot hand etc. In a material heating system (high-frequency heating system), the molding apparatus for molding the heated material and the transport apparatus for loading it into the mold (robot hand etc.) usually are installed separated from each other, so time ended up being required from heating to loading it into the mold and therefore there was the problem that the heated object was not stable in temperature.

SUMMARY OF THE INVENTION

The present invention, in view of the above problems, provides a dielectric heating system which secures ease of loading and unloading of an object to be heated, prevents leakage of the high frequency wave, and enables a heated object to be efficiently loaded into a later process.

To achieve this, the aspect of the invention of claim 1 provides a dielectric heating system which heats a dielectric object to be heated in a closed space by dielectric heating, the dielectric heating system being provided with a high frequency oscillator, a housing which forms part of a waveguide or a housing which has electrodes at part of the housing wherein the housing is provided with a loading opening and unloading opening, first and second conductive closing members which respectively close the loading opening and the unloading opening from the inner side of the housing, and a first position holding member which holds the object to be heated inside the housing, making the first conductive closing member slide to open the loading opening and charging the object to be heated into the housing and making the second conductive closing member slide to open the unloading opening and unloading the object to outside the housing.

Due to this, it is possible to secure ease of loading and unloading an object to be heated to and from a housing while reliably preventing leakage of the high frequency wave and performing dielectric heating. Furthermore, it is possible to efficiently load a heated object to a processing machine or mold or other later process right after heating.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

Figure 1:
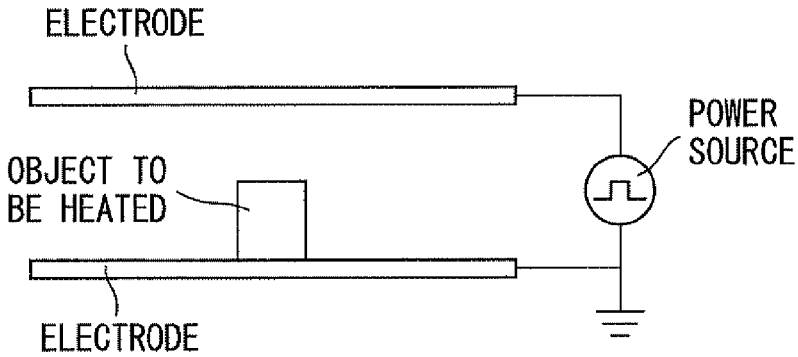
FIG.1 (PRIOR ART)
FIG. 1 is an explanatory view of prior art which places an object to be heated between parallel electrodes for dielectric heating.
Figure 2:
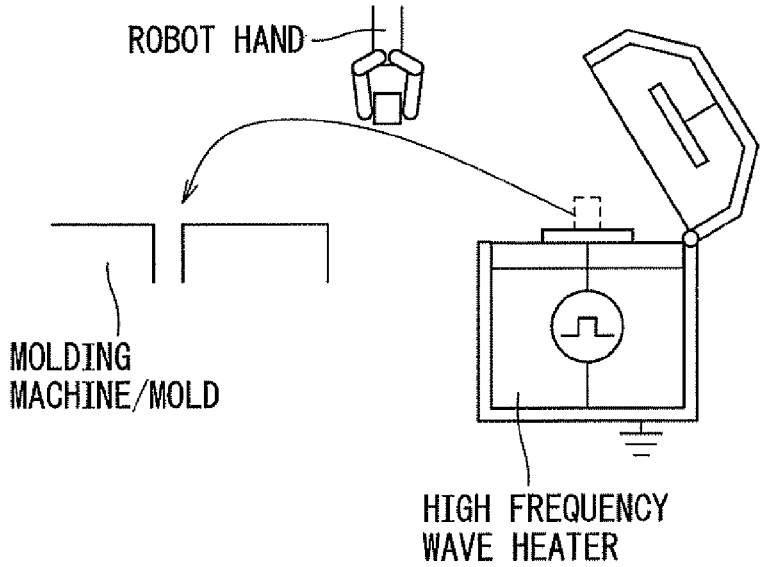
FIG.2 (PRIOR ART)
FIG. 2 is an explanatory view which explains handling at the time of taking out a heated material in prior art.

Below, referring to the drawings, embodiments of the present invention will be explained. In the embodiments, parts of the same configuration will be assigned the same reference numerals and explanations will be omitted.

First Embodiment

Figure 3:
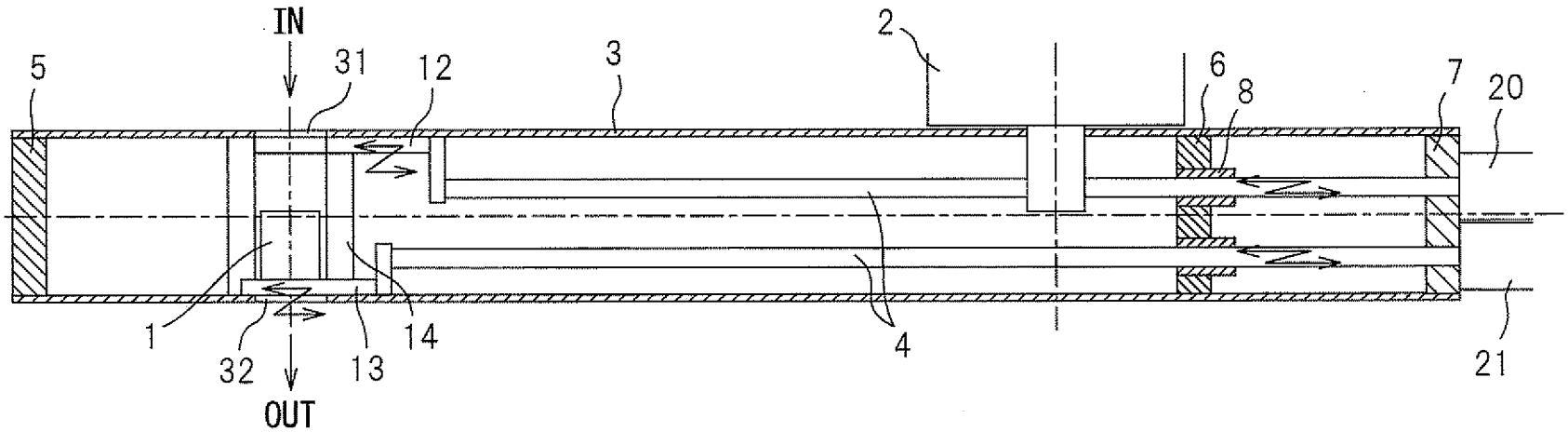
FIG. 3 is an explanatory view for explaining a first embodiment of the present invention.

Referring to FIG. 3, a first embodiment of the present invention will be explained. A waveguide 3 is closed by partition plates 5, 6, and 7 to form a housing. In the housing, a magnetron 2 is set so as to enable generation of a high frequency wave inside. The microwave which is generated by the magnetron 2 is converted to a standing wave by using the waveguide 3. An object to be heated 1 is set inside the waveguide 3 and is heated by dielectric heating. The waveguide 3 is an aluminum or other metal pipe, here, is a usually used box shaped waveguide. The cross-section of the waveguide is not necessarily limited to a rectangular shape and may also be a circular shape or any other shape. The present embodiment may also be applied between electrodes such as in FIG. 1. The device for heating the dielectric material is not limited to a magnetron. Another high frequency oscillator may also be used. Further, a waveguide itself is not necessarily required. These are not limited to the present embodiment and apply to the other embodiments as well.

The object to be heated 1 is a dielectric material such as a synthetic resin. The heating device of the present invention, not limited to the embodiment, is suitable for heating a thermosetting resin such as an epoxy resin or phenol resin. In the case of the first embodiment, the waveguide 3 is provided, coaxially, with a loading opening 31 and an unloading opening 32. The first and second conductive closing members 12 and 13 respectively close the loading opening 31 and the unloading opening 32 at the time of heating. The first and second conductive closing members 12 and 13 slide by air cylinders or other drive actuators 20 and 21 through the rods 4. The left ends of the rods 4 of FIG. 3 are fastened to the first and second conductive closing members 12 and 13.

The rods 4 are rod-shaped members of low permittivity and dissipation factor materials (alumina, polytetrafluoroethylene (PTFE), etc.) which are driven from outside of the waveguide 3. Leakage of the microwave from the drive-use rods 4 is reduced by covering the rods 4 by cylindrical conductive materials 8. Further, the metal housings of the drive actuators 20 and 21 are made to closely contact the partition plate 7 for covering and thereby prevent leakage. In the other embodiments as well, a similar configuration is adopted.

When transporting the object to be heated 1 by utilizing gravity, the loading opening 31 is provided at the top of the waveguide 3 and the unloading opening 32 is provided at the bottom. If using suction or discharge of air or rods or other assist, these openings do not necessarily have to be provided above and below each other and can be set coaxially in any direction. In the case of the first embodiment, inside of the waveguide 3 between the loading opening 31 and the unloading opening 32, an immovable first position holding member 14 is set so that its center axis becomes coaxial with the loading opening 31 and unloading opening 32. The loading opening 31, unloading opening 32, and first position holding member 14 are not limited in cross-sections to circular shapes and may also have rectangular shapes. Here, "coaxial" does not indicate coaxial in the strict sense and includes substantially coaxial.

The first position holding member 14 is comprised of a low permittivity and low dissipation factor member (alumina, PTFE, etc.) The same is true for the later explained second and third position holding members as well. The electrodes, waveguide, and conductive closing members 12 and 13 which close the openings are preferably Al or its alloy, Cu or its alloy, etc. Further, as a material with a low permittivity and low dissipation factor compared with the object to be heated 1, polypropylene (PP), PTFE, alumina, glass, etc. are preferable. In particular, for the sliding parts, PTFE, PP, etc. are preferable.

Referring to FIG. 3, the operation in the case of the first embodiment will be explained. The left direction in FIG. 3 is defined as "advanced" and the right direction as "retracted". The first conductive closing member 12 is made to retract from the loading opening 31 for the object to be heated so as to open the loading opening 31, then the object to be heated is loaded into the loading opening 31. At this time, the unloading opening 32 for the object to be heated is closed by the second conductive closing member 13. The loaded object to be heated 1 is constrained in position by the first position holding member 14 and the second conductive closing member 13. The loading opening 31 is closed by making the first conductive closing member 12 advance. After that, a high frequency wave is applied to heat the object to be heated 1.

After heating, the unloading opening 32 is opened by making the second conductive closing member 13 retract, then the heated object is unloaded and dropped through a chute etc. to be loaded into a processing machine of a later process. In unloading the object, a mechanism may be provided which uses rods, air, or other assist for unloading. Further, the first and second conductive closing members 12 and 13 may be provided outside of the housing, that is, outside of the electrodes and outside of the waveguide. As one example of a processing machine, a transfer molding machine which molds a thermosetting resin (epoxy etc.) etc. may be mentioned. As an illustration of an object to be heated 1, as a part which is obtained by transfer molding etc. of the above-mentioned epoxy resin etc., an IC package etc. may be mentioned, but the invention is not limited to this. The embodiments of the present invention can be applied broadly in general use processing machines. Due to this, it is possible to use fewer component members to realize electrodes or closing or opening of waveguide openings, facilitate the loading and unloading of an object to be heated 1, and suppress leakage of the high frequency wave.

The first and second conductive closing members 12 and 13 are provided to respectively close the loading opening 31 and unloading opening 32 from the inside of the housing. When providing these closing members at the outside of the waveguide, the outside dimensions of the system become larger. To keep the larger size of the facilities and longer operating stroke from causing a drop in productivity and a rise in processing costs as well, it is effective to not provide the parts outside of the waveguide as much as possible and to work to reduce the size. The position holding members which hold the object to be heated and the closing members which close the waveguide openings are set inside of the waveguide, so the outside dimensions of the present embodiment can be made smaller. For this reason, even when making the unloading part of the present embodiment enter inside the processing machine (specifically, between the open mold halves), there is no need to open up the mold wider. Further, as explained later, when the position of a material in a waveguide can be moved, it is possible to reduce the stroke which is required for entry. In this way, it is possible to realize a structure which is designed to heat a material and prevent leakage of a microwave by a small size system.

Second Embodiment

Figure 4:
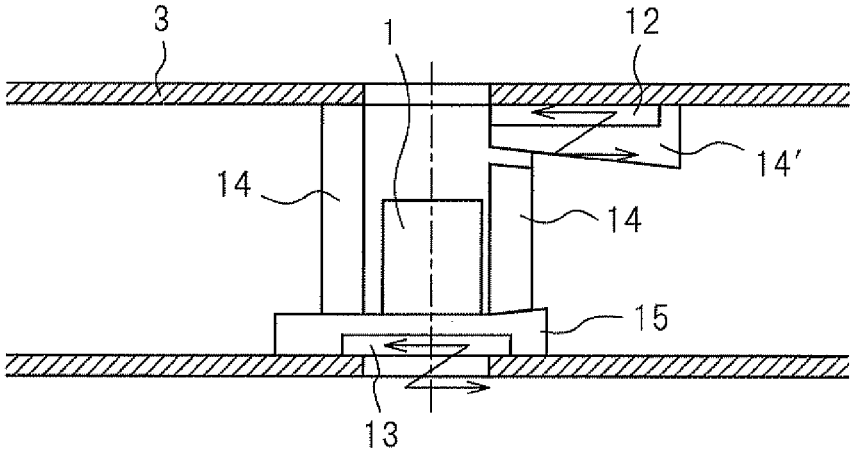
FIG. 4 is an explanatory view for explaining a second embodiment of the present invention.

In a second embodiment which is shown in FIG. 4, in the same way as the first embodiment, a loading opening 31 and an unloading opening 32 are arranged on the same axis and, between the loading opening 31 and the unloading opening 32, an immovable first position holding member 14 is also set on the same axis. A first conductive closing member 12 is set on a third position holding member 14' and slid by a rod 4 which is provided integrally with the third position holding member 14'. A second conductive closing member 13 is set on a second position holding member 15 and slid by a rod 4 which is provided integrally with the second position holding member 15.

As shown in FIG. 4, between the first position holding member 14 and the second position holding member 15, one or both of the first position holding member 14 and the third position holding member 14' are provided with a wedge type connection. By sliding movement of the second position holding member 15 or the third position holding member 14', the first conductive closing member 12 or the second conductive closing member 13 can be made to press against and close the loading opening 31 and the unloading opening 32.

The operation of the second embodiment of the present invention becomes as follows. When an object to be heated 1 is loaded into the loading opening 31, the object to be heated 1 is held in position by the first position holding member 14 and the second position holding member 15. The first conductive closing member 12 and the third position holding member 14', which are formed integrally each other, are made to advance to close the loading opening 31. At this time, the taper surface which is provided at the first position holding member 14 and the taper surface which is provided at the third position holding member 14' are connected by a wedge action (first wedge connection). For this reason, after the object to be heated 1 is loaded into the loading opening 31, the first conductive closing member 12 can be pushed against and close the loading opening 31.

Before loading the object to be heated 1 in the loading opening 31, the second conductive closing member 13 and the second position holding member 15 which are joined integrally each other, are already advanced, so the taper surface which is provided at the first position holding member 14 and the taper surface which is provided at the second position holding member 15 are connected by a wedge action (second wedge connection). The second conductive closing member 13 is pushed against and closes the unloading opening 32. After the first and second conductive closing members 12 and 13 are closed, a high frequency wave is applied to heat the object to be heated. After this, the unloading opening 32 is opened by making the second conductive closing member 13, and the second position holding member 15 which are joined integrally each other, retract and the heated object is unloaded. In this embodiment, the first position holding member 14 is fastened to the waveguide 3 and is immovable and is provided with both the first and second wedge connections. (Note that even with just one of the first and second wedge connections, the leakage is reduced by that amount, so this is effective.)

In this way, when the taper surfaces are connected by a wedge action, leakage of an electrical wave can be prevented. If an electromagnetic wave leaks, electric power which can be used for heating the material is lost. This power loss ends up resulting in a longer heating time. Further, inside the waveguide, due to the effects of the microwave, a potential distribution is formed. This potential distribution acts on both the first and second conductive closing members 12 and 13. If the first and second conductive closing members 12 and 13 are pushed by the first and second wedge connections against the inside walls of the waveguide, there will no longer be any clearance at the interface between these and the inside walls of the waveguide and there will also no longer be a potential difference with the waveguide. In general, at locations where a potential difference is formed, a discharge phenomenon (sparks) occurs and the input power is greatly consumed, so the material heating time is greatly prolonged. Further, if the discharge phenomenon is large, the first and second conductive closing members 12 and 13 and the waveguide are liable to melt bond. According to the ANSI standard, it is known that the power density of the leaking electromagnetic waves has to be kept down to 5 $mW/cm^2$ or less (for reducing effect on human body).

Third and Fourth Embodiments

Figure 5:
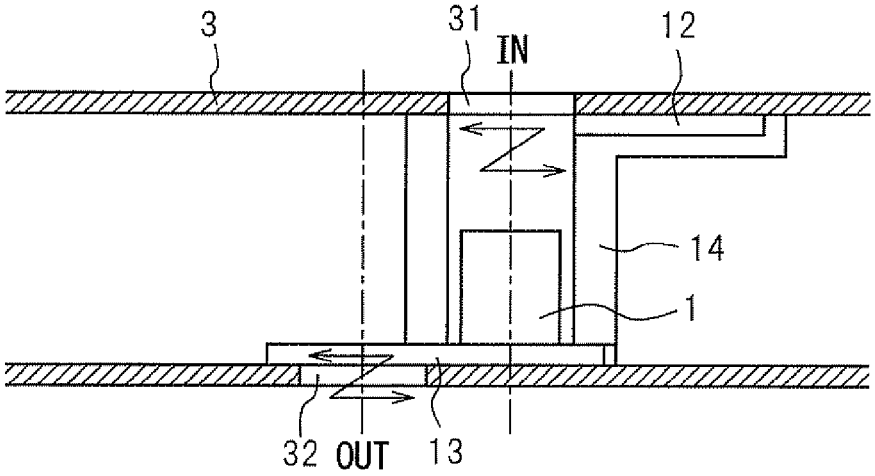
FIG. 5 is an explanatory view for explaining a third embodiment of the present invention.

In third and fourth embodiments, the first position holding member 14 moves the object to be heated 1 from the loading part position (IN) of the loading opening 31 to the unloading part position (OUT) of the unloading opening 32. The first conductive closing member 12 is set at the first position holding member 14 and slides integrally with the first position holding member 14. In the fourth embodiment of FIG. 6, the second conductive closing member 13 is set at the second position holding member 15 and slides together with the second position holding member 15. In the third embodiment of FIG. 5, there is no second position holding member 15, and the second conductive closing member 13 slides. The movement is performed by a rods 4 in the same way as the above-mentioned embodiments.

The action and effect of the third and fourth embodiments are as follows: The loading opening 31 is closed by making the first conductive closing member 12 and the first position holding member 14 which are integrally joined each other, advance to make the object to be heated move from the IN position to the OUT position and to close the opening. Further, a high frequency wave is applied to heat the object to be heated. The unloading opening 32 is opened by making the second conductive closing member 13 retract and to unload the heated object 1. In the fourth embodiment, the second conductive closing member 13 and the second position holding member 15 which are joined integrally each other, are made to retract to open the opening and unload the heated object 1. The merits of this structure are that, in addition to the merits of the first embodiment, by providing the loading part IN (loading opening 31) and the unloading part OUT (unloading opening 32) at different positions, the distance of movement to the processing machine can be shortened (for example, the distance of movement between the loading position of the object to be heated and the loading position of the heated object at the processing machine etc.).

Further, inside the waveguide, in the same way as there are antinodes and nodes in vibration, there are strong spots and weak spots in the field intensity. For this reason, the point of the ability to move the first position holding member 14, so that the object to be heated 1 can be held at any position inside of the waveguide (for example, a position with the highest field intensity), is also one of the important advantageous effects of the invention. Further, by moving the first position holding member 14, in accordance with the target temperature of heating of the object to be heated 1, it is possible to suitably adjust the strength position of the field intensity inside of the waveguide at the time of heating. In the case of the first and second embodiments as well, the loading opening 31 and unloading opening 32 should be set at positions of the highest field intensity.

Fifth Embodiment

Figure 6:
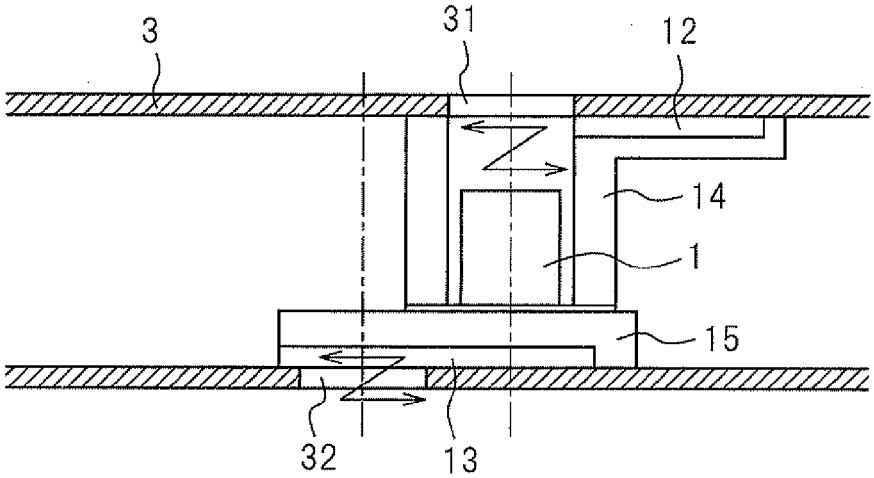
FIG. 6 is an explanatory view for explaining a fourth embodiment of the present invention.
Figure 7:
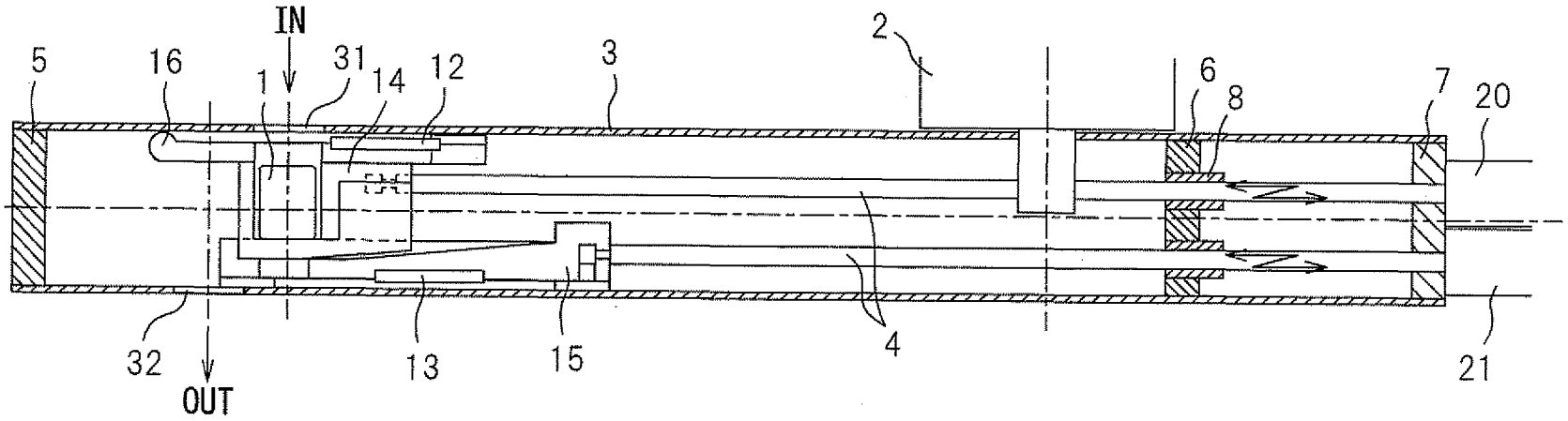
FIG. 7 is an explanatory view for explaining a fifth embodiment of the present invention.
Figure 8A:
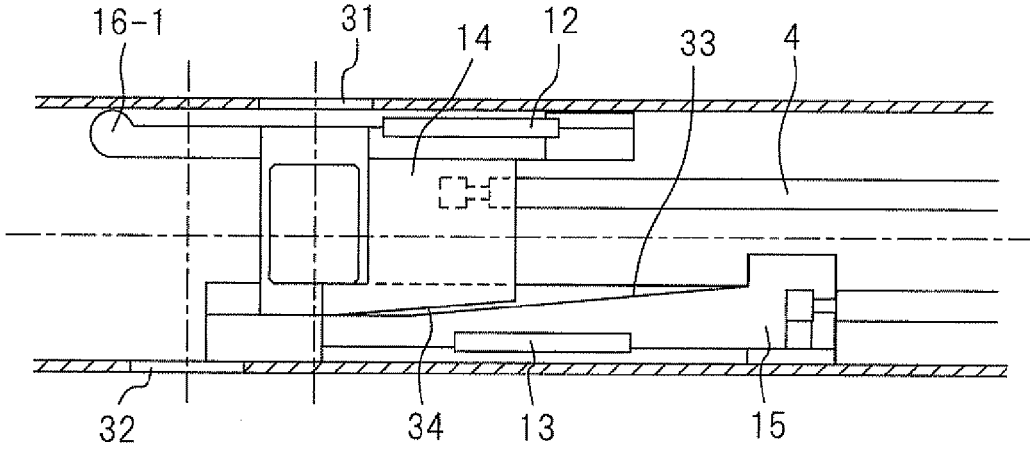
FIG. 8A is a cross-sectional view of principal parts which explains the fifth embodiment of the present invention.

In a fifth embodiment which is shown in FIG. 7, in the same way as the third and fourth embodiments, a first position holding member 14 causes an object to be heated 1 to move from a loading part position (IN) of a loading opening 31 to an unloading part position (OUT) of an unloading opening 32. The point of difference from the fourth embodiment of FIG. 6 is that a wedge connection is provided between a first position holding member 14 and a second position holding member 15. Furthermore, as shown in FIG. 8A, first and second conductive closing members 12 and 13 are kept from directly sliding against the wall surface of the inside of the waveguide by the provision of the projecting sliding parts 16-1, 16-2, 17-1, and 17-2 of FIGS. 8B and 8C. The structural members which are used for the sliding parts are preferably PTFE, PP, etc.

If, in this way, the first and second conductive closing members 12, 13 are kept from directly sliding against the wall surface of the inside of the waveguide, it is possible to prevent wear due to direct sliding from causing clearances to be formed. Further, it is possible to prevent dust from wear from being caught up and causing abnormal wear of the sliding parts (promoting wear, which promoted wear ends up causing larger clearances to be formed). Furthermore, it is possible to prevent dust from wear caused by sliding from being mixed in with the material and causing problems in quality.

Figure 8B:
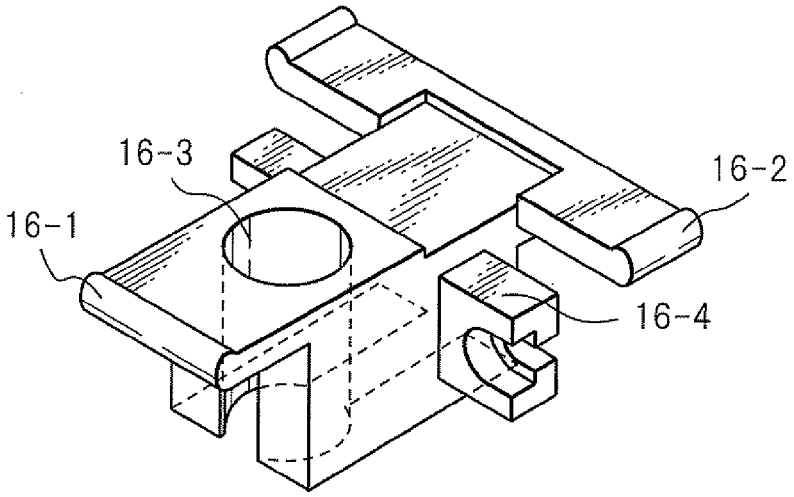
FIG. 8B is a perspective view of a top holding member of the fifth embodiment of the present invention.
Figure 8C:
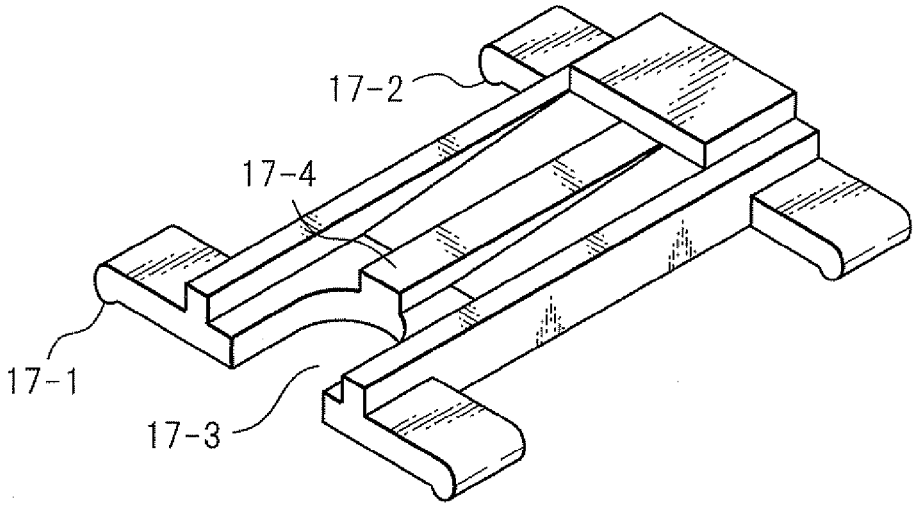
FIG. 8C is a perspective view of a bottom holding member of the fifth embodiment of the present invention.

The projecting sliding parts 16-1, 16-2, 17-1, and 17-2 are supported at the wall surface inside of the waveguide by two points (FIG. 8A) (more precisely, in FIG. 8B, by three points). If forming a wedge connection (taper surfaces 33 and 34) and the rods 4 are advanced, it is possible to make the parts curve to the outside between the two-point supports and possible to make the first and second conductive closing members 12 and 13 respectively push against and close the loading opening 31 and unloading opening 32. In addition, the configuration of the fifth embodiment of FIG. 7 is basically the same as the first embodiment of FIG. 1. In FIG. 8B, the inside of the first position holding member 14 is provided with a hole 16-3 in which the object to be heated 1 is loaded and held. The bracket 16-4 is connected to the end part of the rod 4. The notch 17-3 in FIG. 8C is for enabling the object to be heated 1 which is placed at the holding surface 17-4 to be dropped down through the unloading opening 32 by suitable extension or contraction of the two rods 4.

Figure 9:
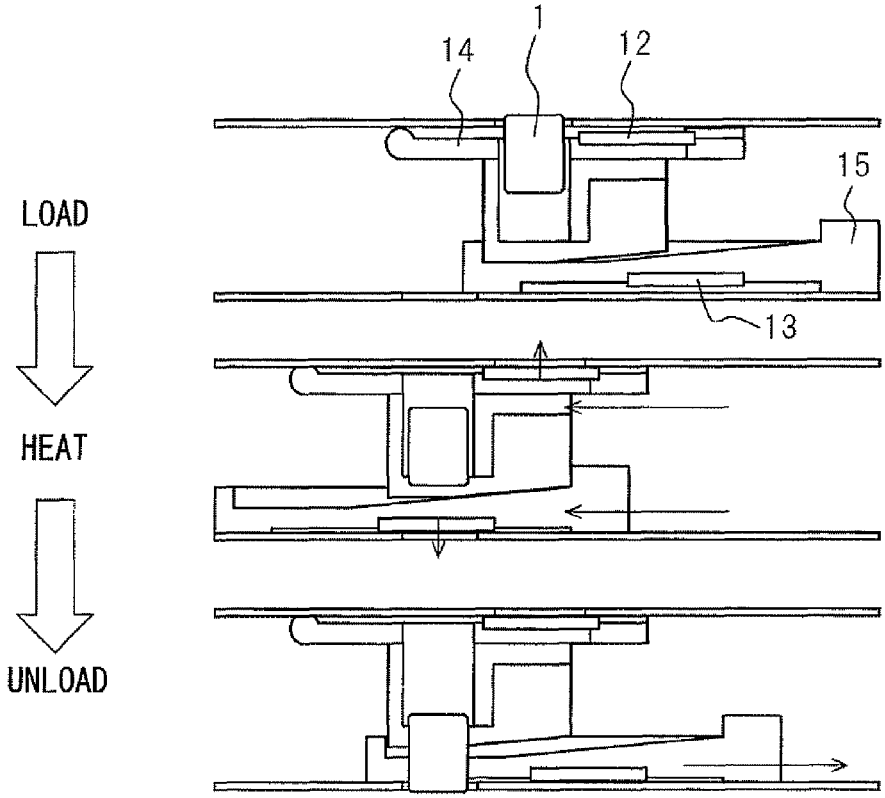
FIG. 9 is an explanatory view which explains the operation of the fifth embodiment of the present invention.

Referring to FIG. 9, the operation of the fifth embodiment will be explained. The first conductive closing member 12 and first position holding member 14 are made to retract from the loading opening 31 and the loading opening 31 is made to open. Here, at the time of loading, the rods 4 are controlled to place the hole 16-3 of the first position holding member 14 on substantially the same axial line as the loading opening 31 of the waveguide. At this time, the unloading opening 32 is opened by the second conductive closing member 13 and the second position holding member 15. If the loading opening 31 is opened, the object to be heated 1 is loaded. The loaded object to be heated is constrained in position by the first and second position holding members 14, 15. The object to be heated 1 is placed on the holding surface 17-4 of the second position holding member 15.

The first conductive closing member 12 and first position holding member 14 are made to advance through the loading opening 31 to close it. At this time, the second conductive closing member 13 and the second position holding member 15 may be simultaneously made to advance. The taper surface 34 which is provided at the first position holding member 14, and the taper surface 33 which is provided at the second position holding member 15, mate whereupon the first and second conductive closing members 12 and 13 are pushed by the waveguide 3 and closed. The high frequency wave is applied to head the object to be heated 1. The second conductive closing member 13 and the second position holding member 15 are made to retract to open the opening, then the heated object to be heated 1 is unloaded and is transported by a chute etc. to a later process.

While the invention has been described by reference to specific embodiments chosen for purposes of illustration, it should be apparent that numerous modifications could be made thereto by those skilled in the art without departing from the basic concept and scope of the invention.

The invention claimed is:

1. A dielectric heating system that heats a dielectric object to be heated in a closed space by dielectric heating, the dielectric heating system comprising:

a high frequency oscillator, a housing that forms part of a waveguide, wherein the waveguide is provided with a loading opening through which the object is loaded and an unloading opening through which the object is unloaded, first and second conductive closing members that respectively close the loading opening and the unloading opening from an inner side of the waveguide, and a first position holding member which holds the object to be heated inside the waveguide, wherein the first conductive closing member slides to open the loading opening to enable loading of the object to be heated into the waveguide, and the second conductive closing member slides to open the unloading opening to enable unloading of the object to outside the waveguide wherein the first position holding member and a second position holding member, or the first position holding member and a third position holding member, are provided with a wedge connection between the respective pair of holding members, or the first position holding member and the second position holding member, and the first position holding member and the third position holding member, are provided with a wedge connection between the respective pair of holding members, to make the first conductive closing member and the second conductive closing member respectively push against and close the loading opening and the unloading opening.

2. The dielectric heating system as set forth in claim 1, wherein if the first position holding member and the second position holding member are provided with a wedge connection between them, the first position holding member moves the object to be heated from the loading opening position to the unloading opening position.

3. The dielectric heating system as set forth in claim 2, wherein the unloading opening position is provided at a position with the highest field strength in the closed space.

4. The dielectric heating system as set forth in claim 2, wherein the first conductive closing member is set at the first position holding member and slides integrally with the first position holding member.

5. The dielectric heating system as set forth in claim 4, wherein the second conductive closing member is set at the second position holding member and slides integrally with the second position holding member.

6. The dielectric heating system as set forth in claim 5, wherein one or both of the first one or both of the first position holding member and the second position holding member slide to make the first conductive closing member and the second conductive closing member respectively push against and close the loading opening and the unloading opening.

7. The dielectric heating system as set forth in claim 1, wherein the loading opening and the unloading opening are arranged on the same axis and the first position holding member is configured to be immovable in position.

8. The dielectric heating system as set forth in claim 7, wherein the first conductive closing member is set at the third position holding member and slides integrally with the third position holding member and wherein the second conductive closing member is set at the second position holding member and slides integrally with the second position holding member.

* * * * *